US006158625A

United States Patent [19]

Siegel et al.

[11] Patent Number: 6,158,625

[45] Date of Patent: Dec. 12, 2000

[54] ANTI-CLOG PUMP SPRAYER

[75] Inventors: Kenneth D. Siegel, Redondo Beach; Tanny Li, Walnut, both of Calif.

[73] Assignee: Calmar Inc., City of Industry, Calif.

[21] Appl. No.: 09/375,432

[22] Filed: Aug. 17, 1999

[51] Int. Cl.[7] ..... B67D 1/08

[52] U.S. Cl. ..... 222/148; 222/321.1; 222/342

[58] Field of Search ..... 222/148, 321.1, 222/321.2, 342, 372, 373, 383.1, 385

[56] References Cited

U.S. PATENT DOCUMENTS 5,094,364 3/1992 Knickerbocker .
5,105,988 4/1992 Knickerbocker .
5,207,785 5/1993 Knickerbocker .
5,785,208 7/1998 Dobbs et al. .

*Primary Examiner*—Joseph A. Kaufman
*Assistant Examiner*—David Deal
*Attorney, Agent, or Firm*—Dykema Gossett PLLC

[57] ABSTRACT

An anti-clog pump sprayer has a cover mounted for independent reciprocation on a plunger head, the cover having a cupped spring biased portion covering the discharge orifice on the head to avoid clogging on product drying, and being lifted off the orifice during the relative shift for uncovering the orifice in readiness for spraying. The sprayer may also have a product retraction device on the plunger head in communication with the discharge orifice, a projection on the underside of the cover top wall for actuating the device at the commencement of the plunger return stroke for creating a slight sub-atmospheric pressure for suctioning any residual product inwardly of the orifice to thereby avoid clogging.

18 Claims, 6 Drawing Sheets

30
31
32
33
34
35
36
37
38
39
40
41
42
43
44
45
46
47
48
49
51
52
53
54
57
65
67
3
3

41
47
42

41
42
47

41
47
42

41
42
47

54
41
47
42
53
37

41
42
47

55
57
38
58
56
61
59
62
35
37
63
46
44
32
67
66
41
64
42
54
53

ANTI-CLOG PUMP SPRAYER

BACKGROUND OF THE INVENTION

This invention relates generally to manually actuated pump sprayers having an anti-clog feature for improving upon the performance of the pump. More particularly, means are provided to prevent the discharge orifice from drying out during periods of non-use of the pump by sealing the orifice closed against ambient air/or withdrawing product inwardly of the discharge orifice after the product discharge passage is valved closed.

The invention comprises an improvement over the prior commonly owned precompression pump sprayer set forth in U.S. Pat. No. 5,785,208, wherein a cover spring mounted on the actuator head is reciprocable independently of the actuator. The cover has a portion engageable with the discharge orifice for sealing the orifice when at rest and for removing any build up of dried residual product during independent reciprocation which may form at or in the vicinity of the discharge orifice.

During independent reciprocation the cover portion slides along the orifice cup into and out of engagement with the discharge orifice exit which could possibly drag dried product into the spray path during repeated pump use. This could affect the quality of spray therethrough.

Also the cover portion overlying the orifice fails to provide an adequate air seal to prevent the drying and clogging of especially resinous liquid product to be dispensed, such as hair sprays and the like.

The prior art dispenser likewise has a variable volume product retraction chamber formed between the cover and the actuator such that during pumping, the chamber volume communicating with the orifice at one end and the valve at the other end, contracts and expands when the valve is in the closed position, as the cover plunger member reciprocates during actuation. Product is drawn inwardly from the orifice during the actuator return stroke to avoid wiping a residual drop of product that remains at the orifice exit upon the completion of each spray by the cover as it returns to its seal position over the orifice exit. This avoids build up of residual product between the cover and actuator that could result in eventual non-function of the covers relative free motion with the actuator.

The volume of product retracted into the orifice cup channels allows the product to settle, via gravity, to the bottom most portion of the channels allowing air to fill the upper channels and spray mechanics passageways. Thus, in the ensuing pump actuation stroke as the cover moves downward relative to the actuator, prior to initiation of spray via the valve opening under pressure build up, the mixture of air and product in the orifice cup channels sputters out the orifice exit and product drools down between the face of the actuator and interior of the cover accumulating product during each successive stroke. Eventually, this accumulated product dries and binds the cover to the actuator rendering the mechanism nonfunctional. Because the product retraction chamber is formed between the actuator and the cover which requires a minimum fixed stroke for the cover to completely expose the orifice prior to spray initiation, it becomes difficult to change the volume of the chamber and subsequent volume of product retraction from the orifice.

SUMMARY OF THE INVENTION

It is therefore an object of the present invention to provide a manually operated pump sprayer which, in accordance with one anti-clog feature, provides for sealing the discharge orifice from the ambient air to prevent drying of liquid product formed thereat during conditions of sprayer non-use. The seal on the independently reciprocable cover of the invention cups over the orifice in the non-use condition. During relative reciprocation of the cover is caused to gradually shift away from the orifice to avoid orifice contact.

A cooperating cam and cam follower acts between the cover and the plunger to facilitate the gradual shifting of the seal away from the orifice during a downward shift of the cover to expose the orifice during pumping. The seal on the cover overlying the orifice is spring biased in place as by the provision of a spring leg formed integrally with the cover side wall.

In accordance with another anti-clog feature of the invention a depressible product retraction device is provided for withdrawing product inwardly of the orifice after the commencement of the piston return stroke with the discharge valve closed. The device is formed only on the plunger, and is activated by a spaced element on the cover. The device may be formed for example by a piston and cylinder unit, an elastic diaphragm, or a spring washer, or the equivalent.

Other objects, advantages and novel features of the invention will become more apparent from the following detailed description of the invention when taken in conjunction with the accompanying drawings.

DETAILED DESCRIPTION OF THE INVENTION

Figures 1, 2, 3:
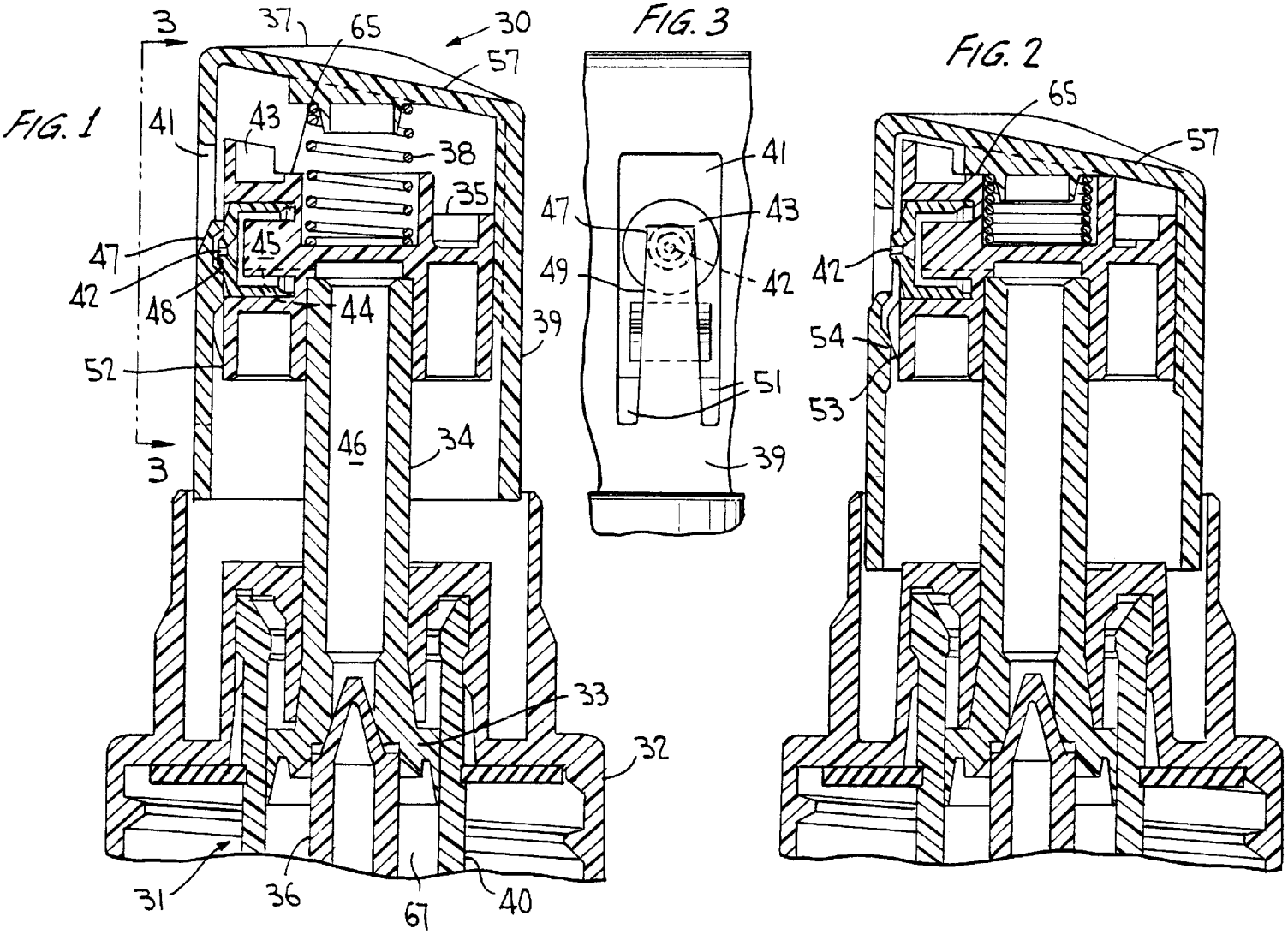
FIG. 1 is a vertical sectional view of a pump sprayer incorporating one anti-clog feature of the invention with the pump shown in its position of non-use.
FIG. 2 is a view similar to FIG. 1 showing the discharge orifice uncovered before the plunger pressure stroke.
FIG. 3 is a partial front elevational view taken substantially along the line 3—3 of FIG. 1.

Turning now to the drawings wherein like reference characters refer to like and corresponding parts throughout the several views, a precompression pump sprayer 30 is shown in FIG. 1 as having a pump body 31 mountable on the neck of a container (not shown) of liquid product to be dispensed by a provision of a closure 32 to which the pump body is snap-fitted similarly as in prior U.S. Pat. No. 5,785,208. The entirety of that patent disclosure is specifically incorporated herein by reference.

The pump body includes a pump cylinder 40 in which a pump piston 33 reciprocates upon the application of an external force applied as will be described, the piston having a plunger stem 34 on which a plunger head 35 is mounted. A discharge poppet valve 36 is shown in FIGS. 1 and 2 seated against its valve seat formed at the confronting lower end of the plunger stem, the poppet being spring biased into its closed position by the provision of a piston return spring (not shown).

A cover 37 is mounted about the plunger head, the cover being independently reciprocable relative to the plunger against the bias of a spring such as a coil spring 38. The cover has an annular side wall 39 containing an opening 41 for exposing discharge orifice 42 formed in a standard orifice cup 43 mounted in the side wall of the plunger head. A spin mechanics (not shown) is formed between the end face of probe 45 and the confronting face of the orifice cup. An external groove 44 in the probe extends between the spin mechanics arrangement and discharge passage 46 defined by hollow stem 34. Product under pressure therefore flows during pumping via passage 46, through groove 44, is swirled via the spin mechanics, and exits through orifice 42 as a spray upon uncovering the orifice as will be described.

Figures 4, 5, 6, 7, 8, 9, 10:
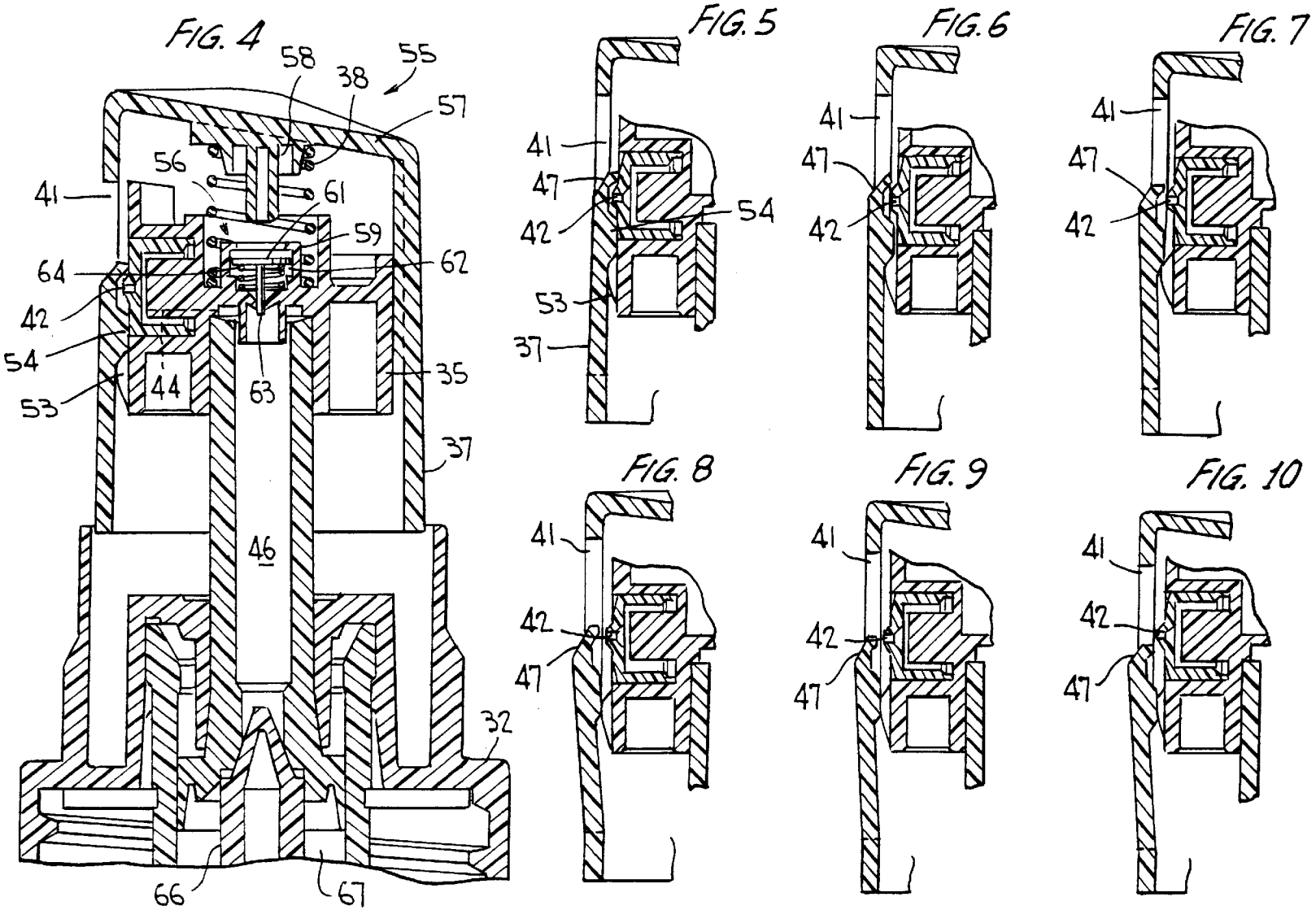
FIG. 4 is a view similar to FIG. 1 illustrating another anti-clog feature according to the invention.
FIGS. 5, 6, 7, 8, 9 and 10 are views similar to FIG. 1 showing in part the relatively reciprocable cover in the process of uncovering the discharge orifice upon its shifting movement relative to that of the plunger.

In accordance with one anti-clog feature of the invention, a portion 47 of side wall 39 seals against the outer face of orifice cup 43 in the non-use position of the pump sprayer shown in FIGS. 1 and 5. The inner surface of portion 47 has a circular cup-shaped depression 48 surrounding the orifice in the non-use position of the pump and sealing about the orifice without bearing directly thereagainst.

Portion 47 is spring biased against the outer face of orifice cup 43 to provide the seal around the orifice, as by the provision of a spring leg 49 formed integrally with side wall 39 formed by a pair of spaced slits 51, as clearly shown FIG. 3.

The spring force of the cover spring being less than the spring force of the piston return spring, similarly as in the U.S. Pat. No. 5,785,208 sprayer, cover 37 is capable of being shifted independently of the reciprocation of the plunger from its non-use position of FIG. 1 to its lowered position of FIG. 2 against the bias of its cover spring 38, to thereby expose discharge orifice 42 in readiness for spraying. During the course of the downward relative shift of the cover, portion 47 of the side wall is lifted off the front face of the orifice cup gradually during cover depression, by the provision of a cam 53 and a cam follower 54 acting between spring leg 49 and the confronting side wall 52 of the plunger head. For example, the cam may be in the form of a ramp provided on side wall 52 forming a camming surface, and cam follower 54 may be provided on the inner face of leg 49 which, during downward shifting movement of the cover from its FIG. 1 to its FIG. 2 positions, causes portion 47 of leg 49 to lift off the front face of the orifice cup gradually as shown in sequence in FIGS. 5 to 10. Of course, the ramp and the cam follower could be otherwise located on the inner face of leg 49 and the outer face of the plunger skirt, respectively, without departing from the invention.

In the FIG. 2 position, the underside of top wall 57 of the cover and the upper end of the plunger head are brought into contact with one other such that upon continued depression of the cover, the plunger head is reciprocated against the bias of the piston return spring for the dispensing of product in the manner known in the art through an open discharge along passage 46, groove 44 and into the spin chamber defined between probe 45 and the orifice cup at which a vortex is induced prior to discharge through the orifice 42 in the form of a spray.

Another anti-clog feature of the invention according to one embodiment is illustrated in FIG. 4 in which the manually operated pump sprayer 55 has a product retraction device 56 in open communication with the discharge orifice so that on actuation, a suck-back is created effecting the withdrawal of product inwardly of the orifice to thereby avoid clogging due to dried product in and around the orifice. Such device 56 is provided solely on the plunger head 35. The underside of top wall 57 of the cover has a probe or a projection 58 extending toward device 56 for actuating the same as will be described.

The product retraction device of FIG. 4 comprises a cylinder 59 formed integrally at the upper end of the plunger head, and a piston which may be in the form of a disc 61 (which may be metallic) defining together with cylinder 59 a variable volume chamber 62 having a central opening in its bottom wall through which a guide pin 63 of disc 61 extends. The pin and/or the central opening has a plurality of spaced grooves or the like to establish communication between chamber 62 and the discharge orifice via groove 44.

In operation, upon depression of the cover from its FIG. 5 to its FIG. 10 position, which together with FIGS. 6, 7, 8 and 9 show the sequential uncovering of the discharge orifice as cupped portion 47 of side wall 39 is lifted away from the discharge orifice without contact, projection 58 will in the FIG. 10 position of the cover have depressed piston disc 61 completely against the bias of its light return spring 64, whereupon the underside of top wall 57 of the cover contacts upper edge 65 of the plunger head as explained with reference to FIGS. 1 to 3. Continued application of external finger force against the cover reciprocates the plunger and piston against the bias of its return spring. As in any precompression pump sprayer, discharge poppet valve 66 is lowered together with the piston, and with the inlet and discharge valves of the pump closed, pressure within pump chamber 67 builds up to a threshold pressure which overcomes the force of the piston return spring. At this threshold pressure poppet valve 66 is forced downwardly away from its valve seat to open the discharge such that product under pressure is dispensed from pump chamber 67 and out through the uncovered discharge orifice via discharge passage 46, groove 44 and the known spin mechanics. Upon release of the externally applied finger force, cover 37 returns toward its FIG. 4 position under the action of its spring 38 and the piston return stroke commences during which the poppet valve recloses. Upon return of disc 61 to its FIG. 4 position chamber 62 expands and being in communication with the discharge orifice, functions to withdraw product inwardly of the orifice. The miniaturized chamber 62 creates just enough sub-atmospheric pressure during the return stroke of piston 61 to suction product inwardly of the discharge orifice without the formation of air bubbles or pockets behind the product. Therefore, on the ensuing pump pressure stroke, product is discharged through the uncovered discharge orifice via groove 44 and passage 46 without sputtering as would be caused by residual air pockets produced upstream of the orifice. And, at the end of pumping, should any bubble formation occur at the orifice or should the orifice become wetted by product, cupped portion 47 of the cover seals against the outside of the orifice cup to avoid clogging due to drying. On the ensuing pressure stroke of the pump any bubble formation or residual product in and around the orifice is simply discharged without dribbling or sputtering.

Figure 11:
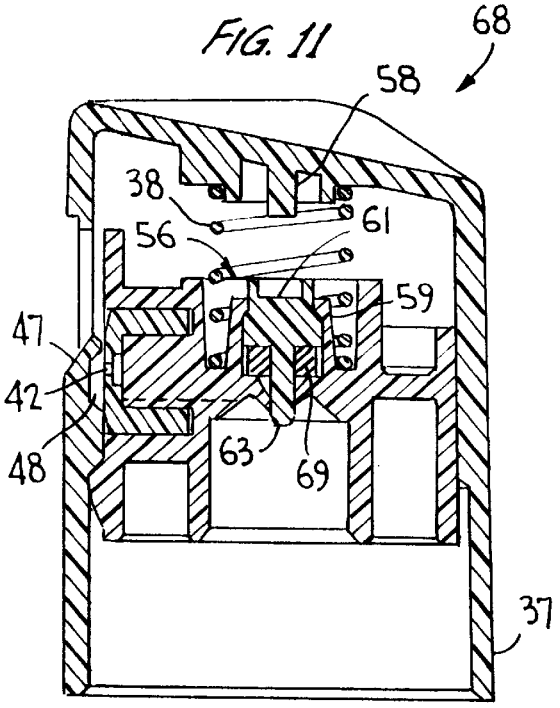
FIGS. 11 and 12 are views similar to FIG. 1 showing another embodiment of a product retraction device with the cover in its extended and depressed positions.
Figure 12:
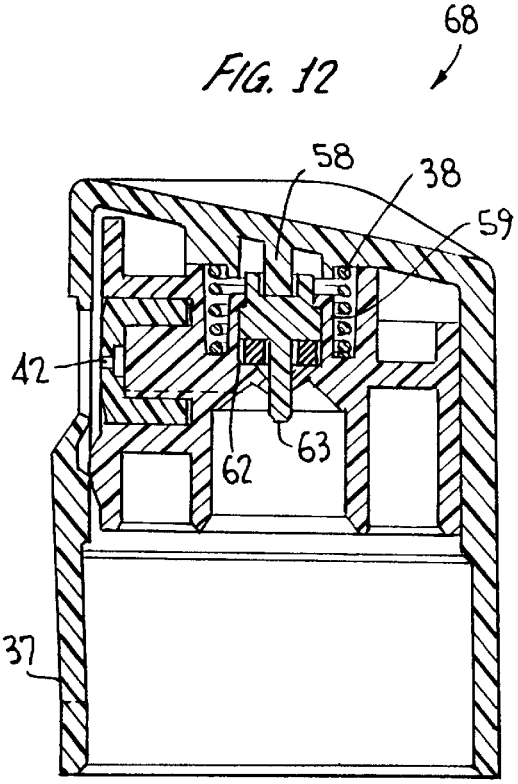

Precompression pump sprayer generally designated 68 in FIGS. 11 and 12 has a product retraction device similar to that of FIG. 4 except that piston 61 and its guide pin 63 are of plastic, and its return spring comprises an elastomeric cushion 69 of foamed plastic or the like which is compressible as shown in FIG. 12 upon actuation by projection 58 for actuating device 56.

Figure 13:
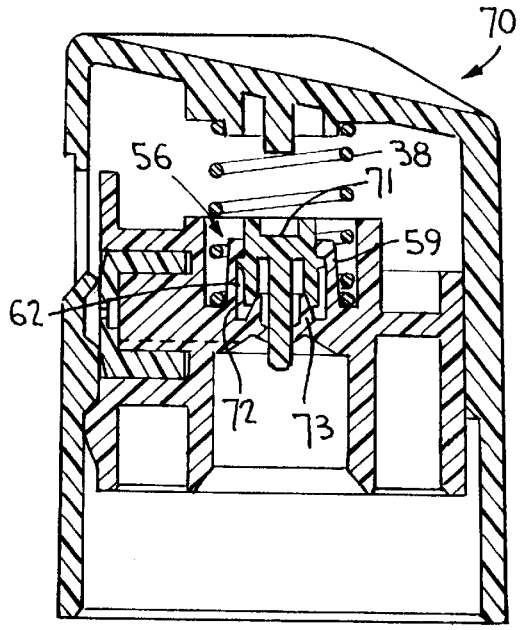
FIGS. 13 and 14 are views similar to FIG. 1 of another embodiment of a product retraction device showing the cover in its extended and depressed positions.
Figure 14:
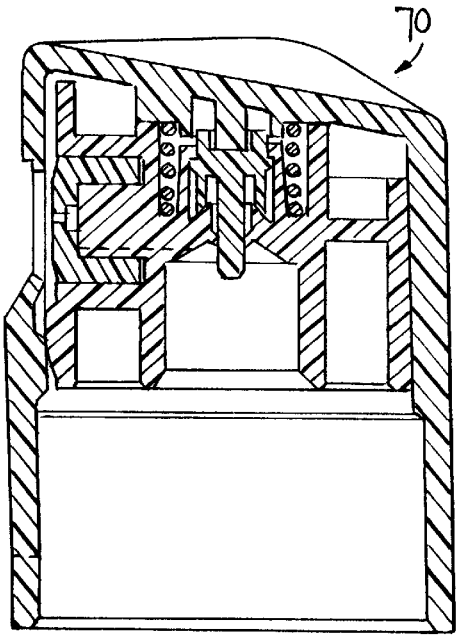

Chamber 56 of the FIGS. 13, 14 embodiment is formed by a piston 71 having a plurality of depending spring legs 72 slidable along the outer conical surface of a collar 73 at the bottom end of chamber 62. The spring legs function in the same manner as coil spring 62 of FIG. 4 and as spring cushion 69 of FIG. 11, while eliminating the need for a separate spring.

Figure 15:
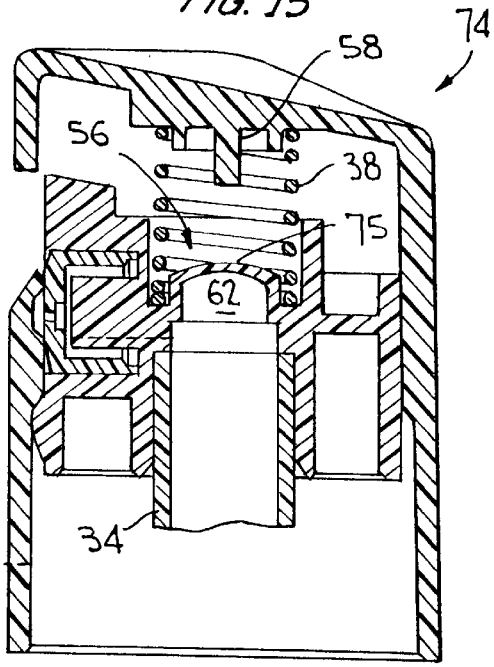
FIGS. 15 and 16 are views similar to FIG. 1 of yet another embodiment of a product retraction device showing the cover in its extended and depressed positions.
Figure 16:
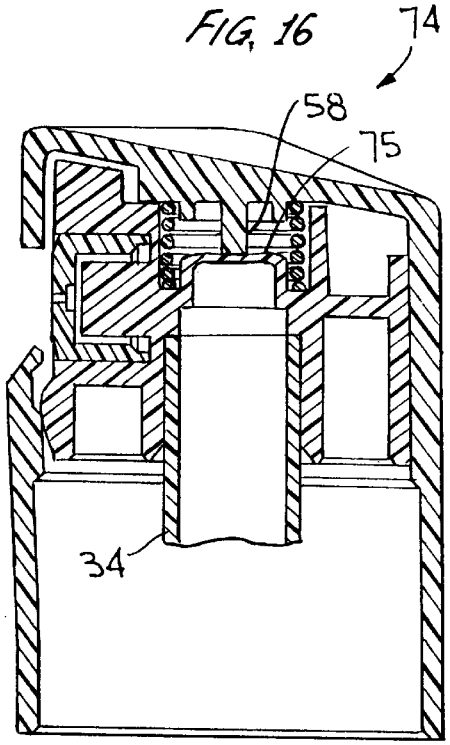

Pump sprayer 74 of FIGS. 15, 16 has its product retraction device 56 formed by an integral snap diaphragm in the form of a spring washer 75 of concavo-convex shape with its concave side facing toward projection 58. Diaphragm 75 defines a miniature chamber 62 therebeneath which after being compressed as shown in FIGS. 16 and expanding back to its position shown in FIG. 15 produces a slight sub-atmospheric pressure to effect withdrawal of product from the discharge orifice as in the manner more fully described in the aforedescribed embodiments.

Figure 17:
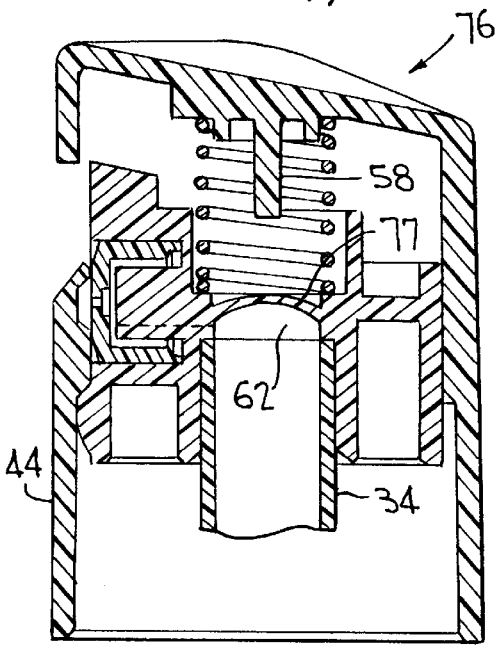
FIGS. 17 and 18 are views similar to FIG. 1 of yet another embodiment of a product retraction device showing the cover in its extended and depressed positions.
Figure 18:
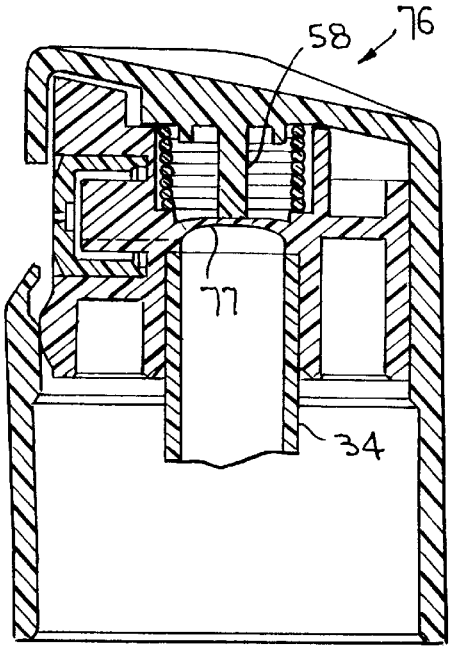

Pump sprayer 76 of FIGS. 17, 18 has a product retraction device likewise defined by an integral concavo-convex diaphragm 77 defining a miniature chamber 62 therebeneath. The diaphragm functions similarly to that of diaphragm 75 of FIG. 15 except for being mounted in place with a shallower side wall forming chamber 62.

Figure 19:
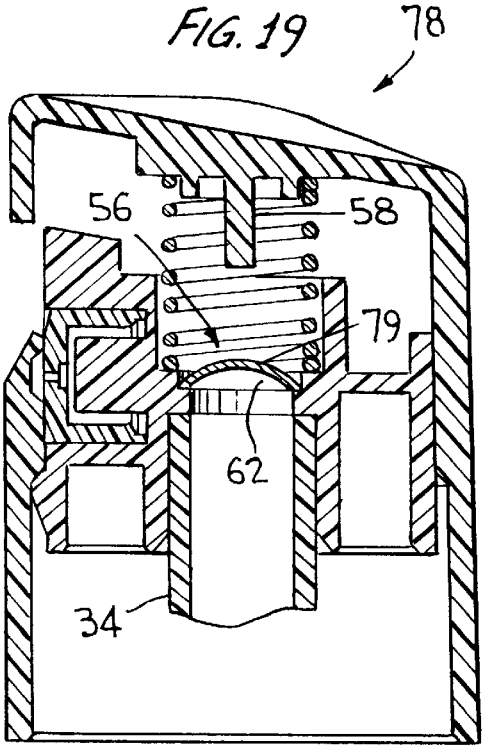
FIGS. 19 and 20 are view similar to FIG. 1 of still another embodiment of a product retraction device showing the cover in its extended and depressed positions.
Figure 20:
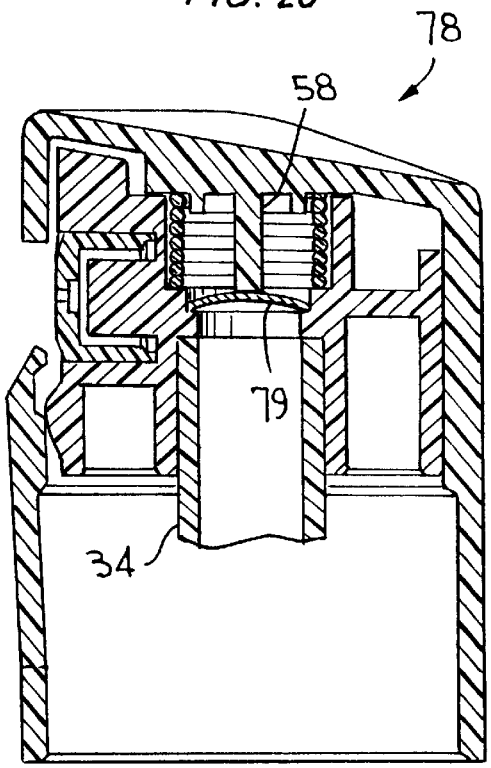

Pump sprayer 78 of FIGS. 19, 20 has its product retraction device 56 defined by a concavo-convex diaphragm 79 similar to that of diaphragm 76 of FIG. 17 except that diaphragm 79 comprises a separate element mounted in place at the upper end of the plunger head. Diaphragm 79 may be of metal or plastic material.

Figure 21:
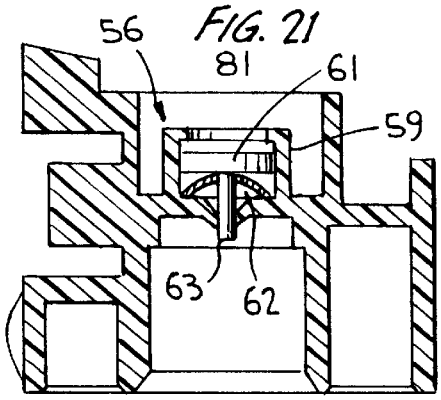
FIGS. 21, 22 and 23 are vertical section views of the plunger head of FIG. 1 of further embodiments of product retraction devices formed by various disc springs.
Figure 22:
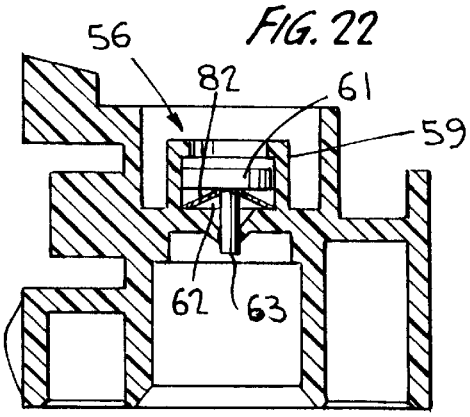
Figure 23:
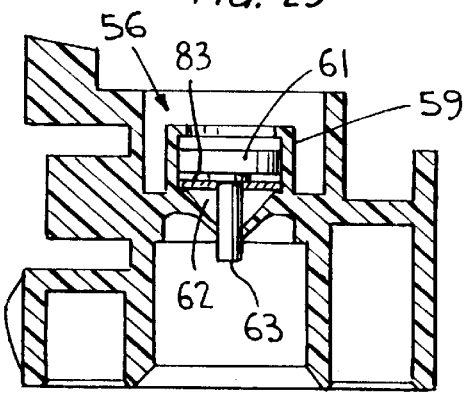

The product retraction device as shown in FIGS. 21, 22 and 23 each includes a cylinder 59 formed integrally at the upper end of the plunger head, and each includes a piston in the form of a disc 61 having a central guide pin 63, similar to that of FIG. 4. Each disc 61 is actuated by projection 58 against the bias of a disc spring. For example in FIG. 21 a spring washer 81 is provided for spring biasing piston disc 61. In FIG. 22 a Belleville spring 82 is provided to facilitate spring return of piston disc 61 upon impact by projection 58, and in FIG. 23 a flat spring 83 is provided for this purpose.

Figure 24:
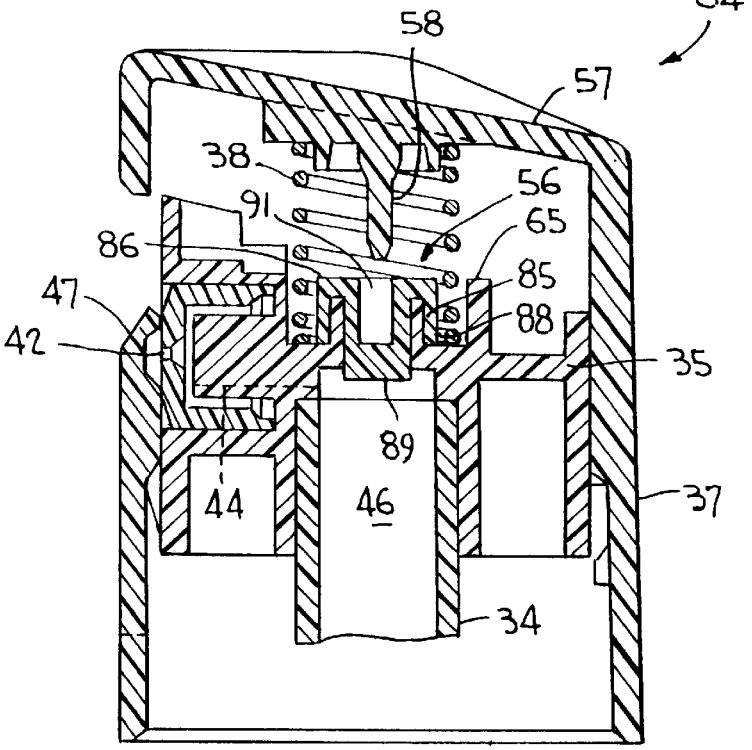
FIGS. 24 and 25 are views similar to FIG. 1 of other product retraction devices in the form of elastic diaphragms.

The pump sprayer generally designated 84 in FIG. 24 has an upstanding collar 85 formed at the upper end of the plunger head 35 on which diaphragm 86 is mounted. The diaphragm is of elastomeric material capable of stretching, such as a soft polyethylene, Santoprene, rubber and the like. The diaphragm has spaced inner and outer annular walls 87, 88 located upon assembly on opposite sides of collar 85, inner wall having a closed bottom 89 presenting with the inner wall a central depression 91.

In operation cover 37 shifts downwardly relative to plunger head 35 upon the application of external finger force against top wall 37 of the cover. As described hereinabove, spring biased portion 47 of the cover lifts away from the discharge orifice as shown in sequence in FIGS. 5 to 10. In the process projection 58 extends into depression 91 and by the time the underside of top wall 57 contacts upper edge 65 of the plunger head the projection will have stretched inner wall 87 of the diaphragm thereby effectively compressing the fluid in passage 46 to a small extent. Continued pressure applied against the cover is transmitted to the plunger which lowers the pump piston in its cylinder to thereby pressurize the liquid product contained in the pump chamber which builds up to a threshold pressure. When that pressure overcomes the force of the piston return spring poppet valve 66 opens the discharge as it shifts away from its seat, as is typical in precompression sprayers of this type. Product thereupon issues out of the discharge orifice under pressure. Upon release of the externally applied finger force the poppet recloses the discharge valve while the return spring commences the return stroke and at the same time the cover return spring returns the cover toward its FIG. 24 position whereupon the chamber defined by passage 46 slightly expands as diaphragm 86 returns to its relaxed position. This slight expansion effects product retraction or suck-back via groove 44 for pulling back product from and around the discharge orifice to avoid clogging and to prevent the formation of air bubbles upstream of the orifice. Also, after the cover returns to its FIG. 24 position, cupped portion 47 recloses and seals around the discharge orifice for preventing clogging due to drying.

Figure 25:
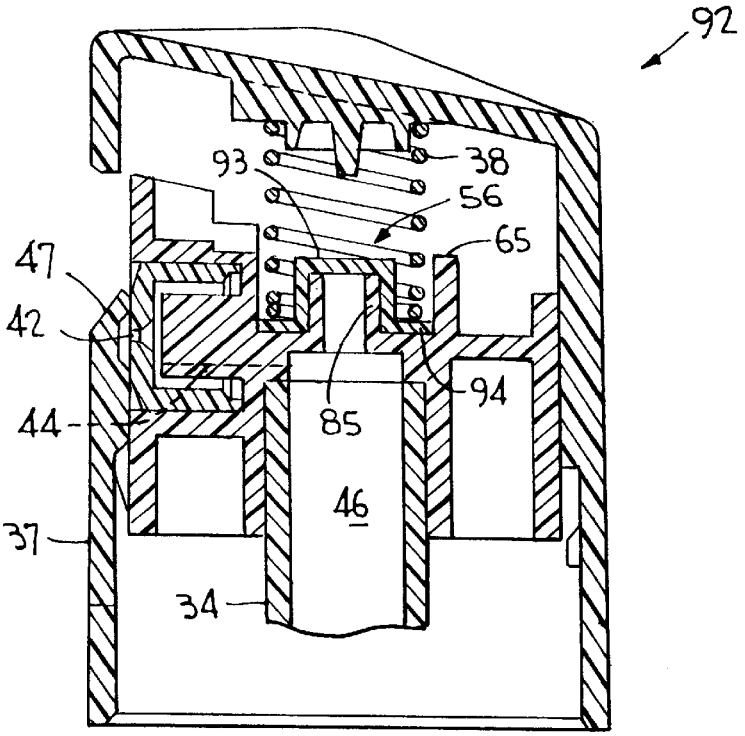

The pump sprayer generally designated 92 in FIG. 25 has its product retraction device 56 comprising an elastomeric diaphragm 93 which is likewise of a stretchy polyethylene, Santoprene, rubber or some other type of elastomer, which is essentially hat-shaped as shown. The annular crown portion of the hat-shaped diaphragm is fitted about collar 85, and the transverse flange 94 provides a support for cover return spring 38 as shown.

During a downward shift of the cover relative to the plunger head, and prior to the underside of the cap top wall engaging upper edge 65 of the plunger head, projection 58 pokes against the crown of diaphragm 93 and stretches the same to slightly compress the volume of discharge passage 46. That volume is increased upon a return shifting movement of the cover toward its FIG. 25 position at the commencement of the piston return stroke as aforedescribed. That expansion creates a slight sub-atmospheric pressure and effects a suck-back of residual product from in and around the discharge orifice prior to the recovering of the orifice by the cupped portion 47.

From the foregoing it can be seen that a simple and economical yet highly effective pump sprayer with one or more anti-clog features has been devised in which a product retraction device is provided solely on the plunger head and is actuated by an independently shiftable cover which engages the product retraction device at the commencement of the plunger pressure stroke, and disengages the product retraction device at the beginning of the plunger return stroke for suctioning any residual product from in and around the discharge orifice to thereby avoid clogging and to prevent the formation of air bubbles upstream of the orifice. The product retraction device slightly increases the volume of the discharge passage which is in communication with the discharge orifice to thereby retract product from the discharge orifice without the formation of any air bubbles forming behind the orifice cup. Since the product retraction device is mounted solely on the plunger head, any leakage between such device and the cover is avoided, and a wide variety of styles of product retraction devices is made possible compared to that available for the prior art. Moreover, the product retraction device according to the invention does not rely on a peak pressure which accumulates in the pump chamber which must exceed the design force of a spring to effect the relative shift between the cover and the plunger head, as set forth in the prior art.

Another anti-clog feature of the invention, which may be employed independently of or together with the aforementioned anti-clog feature, has a spring biased cupped portion on the cover which seals the discharge orifice closed upon a return movement of the cover, and which gradually without contacting the orifice is lifted off the orifice cup upon cover movement toward the plunger.

Obviously many other modifications and variations of the present invention are made possible in the light of the above teachings. It is therefore to be understood that within the scope of the appended claims, the invention may be practiced otherwise than as specifically described.

What is claimed is:

1. A manually actuated pump sprayer comprising, a plunger head having a side wall containing a discharge orifice, said plunger head being reciprocable against a predetermined biasing force provided by a first spring, a cover surrounding said plunger head and being independently reciprocable against a biasing force less than said predetermined force and provided by second spring means, said cover having a side wall with a portion thereof overlying said discharge orifice in a condition of non-use, said side wall having an opening adjacent said portion in alignment with said discharge orifice only upon relative shifting movement of said cover against the biasing force of said second spring means, the improvement wherein said side wall portion seals about said orifice in said non-use position and has a cavity for the containment without drying at said orifice of any product residue formed during pumping, and means acting between said side wall and said plunger for spacing said side wall portion gradually toward and away from said plunger during the relative shifting movement of said cover for covering and uncovering said orifice.

2. The pump sprayer according to claim 1, wherein said means comprise a cam and a cam follower.

3. The pump sprayer according to claim 2, wherein said cam comprises a ramp on an outer surface of said side wall, and said cam follower comprises a cam projection on said cover.

4. The pump sprayer according to claim 3, wherein said cam projection is elongated in a direction of cover reciprocation to a predetermined extent sufficient for said wall portion to uncover said orifice upon said relative shifting movement.

5. The pump sprayer according to claim 1, wherein spring biasing means are provided between said side wall and said side wall portion for sealing said portion around said orifice.

6. The pump sprayer according to claim 5, wherein said spring biasing means comprises a spring arm integral with said side wall portion, a pair of spaced cutouts in said portion defining said arm.

7. The pump sprayer according to claim 1, further comprising a product retraction device on said plunger head, means on said cover for actuating said device upon the relative shifting movement of said cover for drawing in any residual product from said orifice to avoid clogging.

8. The pump sprayer according to claim 7, wherein said device comprises a spring biased piston and cylinder unit.

9. The pump sprayer according to claim 8, wherein said piston is spring biased by means of coil spring.

10. The pump sprayer according to claim 8, wherein said piston is spring biased by means of an elastomeric cushion.

11. The pump sprayer according to claim 8, wherein said piston is spring biased by the provision of at least one spring leg on said piston.

12. The pump sprayer according to claim 8, wherein said piston is spring biased by means of a Belleville spring.

13. The pump sprayer according to claim 8, wherein said piston is spring biased by means of a spring washer.

14. The pump sprayer according to claim 7, wherein said actuating means comprises a projection for reciprocating said piston.

15. The pump sprayer according to claim 7, wherein said device comprises a resilient concavo-convex diaphragm, a concave side of said diaphragm facing an underside of said cover, and said actuating means on said cover being spaced from said diaphragm for engaging said diaphragm during the relative shifting movement of said cover, whereby the diaphragm when actuated serves to retract product from said orifice.

16. The pump sprayer according to claim 15, wherein said actuating means comprises a projection on said cover.

17. The pump sprayer according to claim 15, wherein said diaphragm is integral with said plunger head.

18. The pump sprayer according to claim 15, wherein said diaphragm comprises a separate element affixed to said plunger head.

* * * * *